US010709234B1

(12) United States Patent
Brennan

(10) Patent No.: US 10,709,234 B1
(45) Date of Patent: Jul. 14, 2020

(54) EXPANDABLE TABLE

(71) Applicant: Michael Brennan, Los Osos, CA (US)

(72) Inventor: Michael Brennan, Los Osos, CA (US)

( * ) Notice: Subject to any disclaimer, the term of this patent is extended or adjusted under 35 U.S.C. 154(b) by 0 days.

(21) Appl. No.: 16/677,979

(22) Filed: Nov. 8, 2019

(51) Int. Cl.

| | |
|---|---|
| ***A47B 1/04*** | (2006.01) |
| ***A47B 1/08*** | (2006.01) |
| ***A47B 3/00*** | (2006.01) |
| ***A47B 13/08*** | (2006.01) |
| ***A47B 41/02*** | (2006.01) |
| ***B43L 1/00*** | (2006.01) |

(52) U.S. Cl.
CPC ..... *A47B 1/04* (2013.01); *A47B 1/08* (2013.01); *A47B 3/00* (2013.01); *A47B 13/081* (2013.01); *A47B 13/088* (2013.01); *A47B 41/02* (2013.01); *B43L 1/00* (2013.01); *A47B 2200/12* (2013.01)

(58) Field of Classification Search
CPC .... A47B 1/04; A47B 1/05; A47B 1/08; A47B 2001/053; A47B 3/002; A47B 13/081; A47B 13/088; A47B 41/02
USPC ..... 108/87, 85, 84, 83, 86, 88, 89, 67, 69, 108/65, 11, 17
See application file for complete search history.

(56) References Cited

U.S. PATENT DOCUMENTS 952,408 A * 3/1910 Baugh ..... A47B 1/04 108/69
2,081,212 A * 5/1937 Albano ..... A47B 1/04 108/67
2,102,449 A * 12/1937 Zimmerman ..... A47B 25/00 108/63
2,118,620 A * 5/1938 Orsenigo ..... A47B 1/02 108/67
2,354,106 A * 7/1944 Cooper ..... A47B 17/036 108/63
2,598,804 A * 6/1952 Larson ..... A47B 1/04 108/78
2,602,717 A * 7/1952 Novick ..... A47B 1/08 108/63
2,643,924 A * 6/1953 Albano ..... A47B 1/04 108/77

(Continued)

OTHER PUBLICATIONS

"New Revolving Furniture for Mixed Practices and Interactive Classes," by Dr. Ing. A.H.W. (Piet) Van Der Zanden, Aug. 2014, 12 pages, http://homepage.tudelft.nl/9c41c/flexstool/Revolving_Furniture_for_Interactive_Classes.pdf.

(Continued)

*Primary Examiner* — Jose V Chen
(74) *Attorney, Agent, or Firm* — Saile Ackerman LLC; Stephen B. Ackerman; Rosemary L. S. Pike

(57) ABSTRACT

An expandable table comprises first and second table surfaces connected by a first hinge at their adjoining short sides. First and second legs are fixed to an underside of the first table surface to support the first table surface. A third leg is fixed to an end of a slidable bar or mechanism wherein the slidable bar or mechanism is installed on an underside of the first table surface, wherein the slidable bar or mechanism is configured to be slid out from under the first table surface wherein the third leg provides support for the second table surface when the second table surface is unfolded and wherein the slidable bar or mechanism is configured to be slid under the first table surface wherein the third leg rests adjacent to the first leg when the second table surface is folded to lie on top of the first table surface.

20 Claims, 8 Drawing Sheets

(56) References Cited

U.S. PATENT DOCUMENTS 2,707,138 A * 4/1955 Vangor ..... A47B 1/08 108/83
3,609,892 A * 10/1971 Caire ..... D06F 81/00 38/18
4,055,124 A 10/1977 Weagle
5,036,777 A 8/1991 Barton
5,657,703 A * 8/1997 Johnson ..... A47B 13/16 108/118
5,996,666 A * 12/1999 Denina ..... E04F 10/10 160/202
6,000,343 A * 12/1999 Laney ..... A47B 87/002 108/12
6,161,486 A * 12/2000 Boots ..... A47B 5/06 108/33
6,729,243 B2 * 5/2004 Annas ..... A47B 1/03 108/86
7,628,439 B1 * 12/2009 Strong ..... B62D 33/0273 108/44
7,784,414 B1 * 8/2010 Torres ..... A47B 45/00 108/73
8,100,062 B1 * 1/2012 Anghel ..... A47B 3/08 108/69
D661,515 S * 6/2012 Poost ..... D6/656.16
8,584,598 B2 * 11/2013 Derkoski ..... A47B 3/12 108/14
8,671,850 B2 * 3/2014 Smith ..... A47B 1/04 108/65
8,955,179 B2 * 2/2015 Yu ..... A61B 90/60 5/623
2009/0095204 A1 * 4/2009 Levy ..... A47B 7/02 108/17
2017/0238696 A1 * 8/2017 Ehrreich ..... A47B 3/0912
2018/0344023 A1 * 12/2018 Andersson ..... A47B 1/10

OTHER PUBLICATIONS

SpaceMaster Expanding Desk and Dining Table, https://www.amazon.com White, /SpaceMaster-Corner-Housewares-Expanding-Console/dp/B01EBVNR1M.

* cited by examiner

EXPANDABLE TABLE

TECHNICAL FIELD

The disclosure relates to an expandable table, and more particularly, to an expandable table having a hinged top and sliding leg.

BACKGROUND

It is difficult to use classroom furniture for multiple teaching styles. Current lecture furniture is not good for collaboration and vice versa. Current expandable tables come in three forms:

1) Dining table style leaf system where the table pulls apart and a leaf system is added or folds up. Disadvantages of this style are that the loose leaf sections must be stored, often two people are required to complete the expansion, and it takes minutes to expand the table. This style of expandable table is best suited for dining tables.

2) Drop leaf designs where an extra table surface unfolds from vertical to horizontal positions and a leg pivots out to support the extra surface. Disadvantages are that the size of the expansion is limited, the leaf in the vertical position prevents users from putting their legs under the table while seated, and the pivot leg limits the expansion size.

3) An extra table surface opens book style and an extra table leg pivots out to support the extra surface. Disadvantages are a hinge is on the long side limiting the size of the expansion and the pivot leg limits the size of the expansion.

SUMMARY

A primary objective of the present disclosure is to provide a classroom table that can be easily and quickly converted from a long lecture style table to a shorter and, optionally wider, collaborative style table.

A further objective of the present disclosure is to provide a table that can convert between a lecture style table and a collaborative style table using a book style folding motion with a hinge attached to a short side of the table.

Yet another objective is to provide a table that can convert between a lecture style table and a collaborative style table using a book style folding motion with a hinge attached to a short side of the table and a sliding leg to support the open table surface.

A still further objective is to provide a table that can convert between a lecture style table and a collaborative style table wherein the configuration can be changed by one person in seconds.

Yet another objective is to provide a table that can convert to a vertical mobile whiteboard.

In accordance with the objectives of the present disclosure, an expandable table is described. The expandable table comprises first and second table surfaces connected by a first hinge at their adjoining short sides. First and second legs are fixed to an underside of the first table surface to support the first table surface. A third leg is fixed to a slidable bar or mechanism wherein the slidable bar or mechanism is installed on an underside of the first table surface, wherein the slidable bar or mechanism is configured to be slid out from under the first table surface wherein the third leg provides support for the second table surface when the second table surface is unfolded and wherein the slidable bar or mechanism is configured to be slid under the first table surface wherein the third leg rests adjacent to the first leg when the second table surface is folded to lie on top of the first table surface.

Also in accordance with the objectives of the present disclosure, a method for converting a table from a lecture style configuration to a collaboration style configuration is described. An expandable table is provided comprising first and second table surfaces connected by a first hinge at their adjoining short sides, first and second legs fixed to an underside of the first table surface to support the first table surface and a third leg fixed to an end of a slidable bar or mechanism wherein the slidable bar or mechanism is installed on the underside of the first table surface. In the lecture style configuration, the first and second table surfaces together form a fourth table surface equal to the combined lengths of the first and second table surfaces, wherein the first table surface is supported by the first and second legs and wherein the second table surface is supported by the third leg and the hinge attached to the short side of the first and second table surfaces. To convert from the lecture style configuration to the collaboration style configuration, the second table surface is folded onto the first table surface so that an underside of the second table surface is exposed. The slidable bar or mechanism is slid in fully wherein the third leg rests adjacent to the first leg to form the collaboration style configuration.

Also in accordance with the objectives of the present disclosure, a method to convert a table from a collaboration style configuration to a lecture style configuration is described. An expandable table is provided comprising first and second table surfaces connected by a first hinge at their adjoining short sides, first and second legs fixed to an underside of the first table surface to support the first table surface and a third leg fixed to an end of a slidable bar or mechanism wherein the slidable bar or mechanism is installed on the underside of the first table surface. In the collaboration style configuration, the second table surface is folded over the first table surface. To convert the collaboration style configuration to the lecture style configuration, the slidable bar or mechanism is slid out to its fullest extent. Then, the second table surface is unfolded from the first table surface and rested on the fully extended third leg to form a fourth table surface equal to the combined lengths of the first and second table surfaces, wherein the first table surface is supported by the first and second legs and wherein the second table surface is supported by the third leg and the hinge attached to the short side of first and second surface to form the lecture style configuration.

BRIEF DESCRIPTION OF THE DRAWINGS

In the accompanying drawings forming a material part of this description, there is shown.

DETAILED DESCRIPTION

The expandable table of the present disclosure will allow classrooms to be used for many different teaching styles. The table, in a preferred embodiment, will allow for four students, for example, to sit on one side facing the front of the room in a lecture configuration. The table then transforms to a table that can sit preferably four students, two on each side facing one another in a collaboration configuration. The table also provides the additional feature of acting as a mobile whiteboard. It will be understood that the table could be designed to fit two students, six students, or more, and that illustrations showing a table for four students do not limit the disclosure to a table for four students.

Figure 1A:
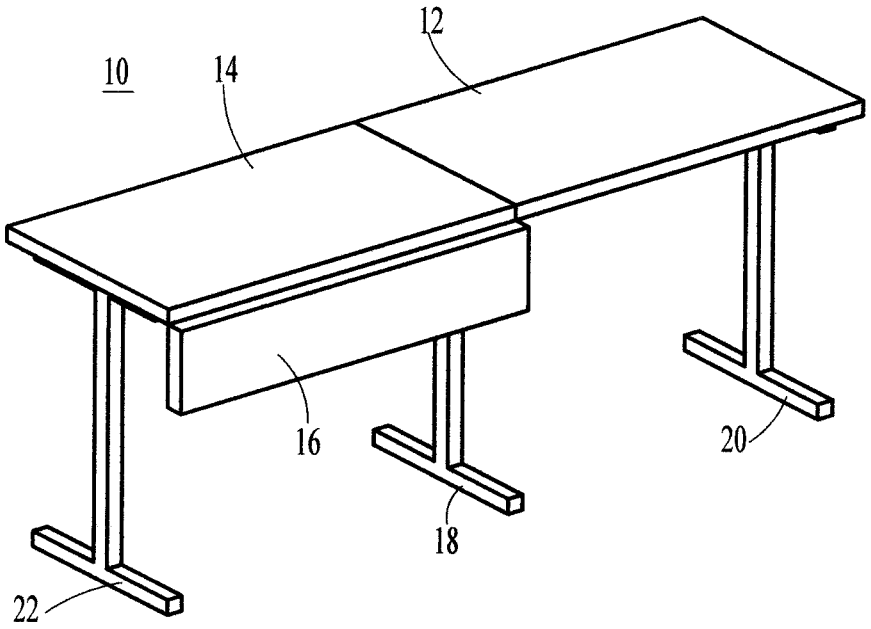
FIGS. 1A and 1B illustrate the lecture style configuration of a preferred embodiment of the present disclosure and two alternative leg styles.
Figure 1B:
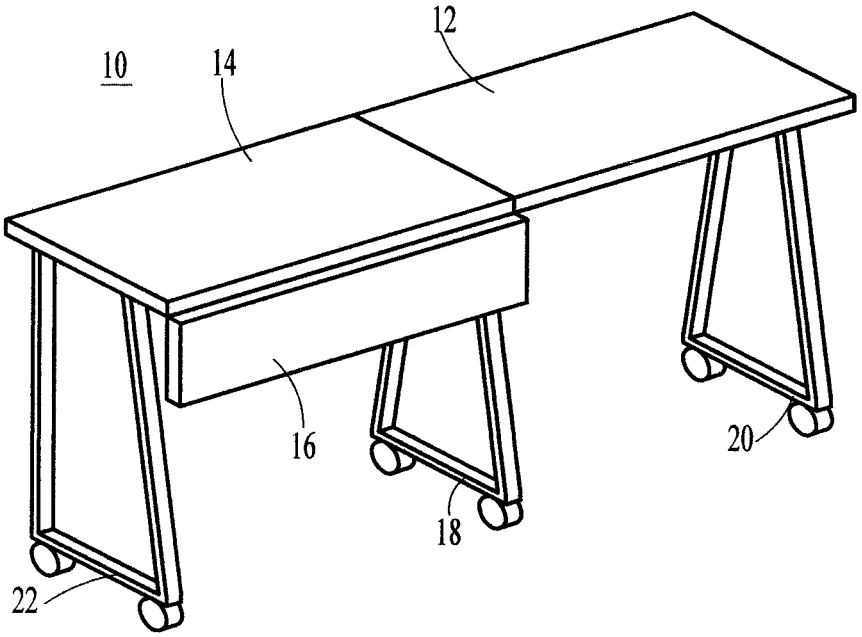

The expandable table of the present disclosure can be used in business training rooms, co-working spaces, restaurants, conference rooms, and meeting spaces as well as classrooms. FIG. 1 illustrates the expandable table of the present disclosure in a lecture configuration. FIG. 1A illustrates one leg style and FIG. 1B illustrates an alternate leg style. Leg style can vary based on design and use of the table and the specific leg style can be changed to suit customer aesthetic desires, including any other leg style not illustrated.

Figure 2:
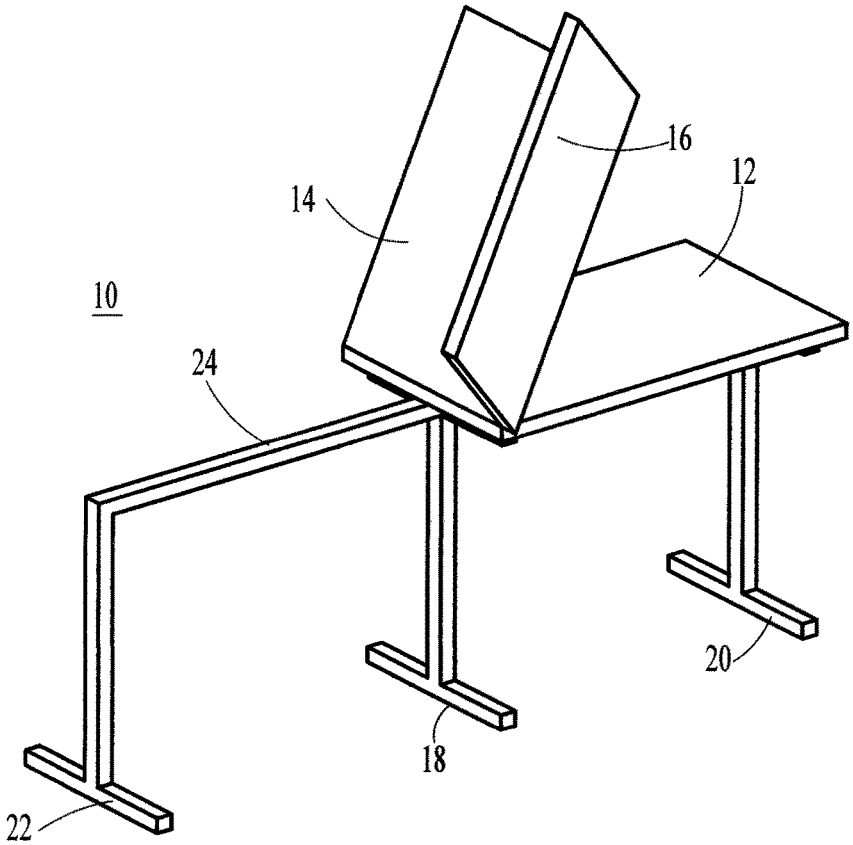
FIGS. 2 through 5 illustrate steps in converting the preferred embodiment of the present disclosure from a lecture style configuration to a collaborative configuration.
Figure 3:
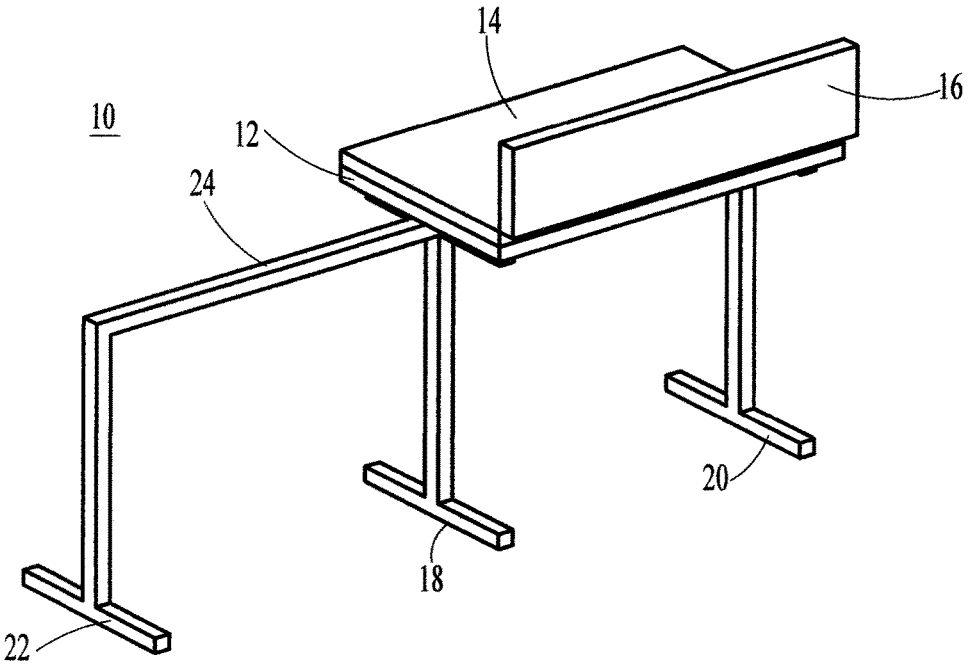
Figure 4:
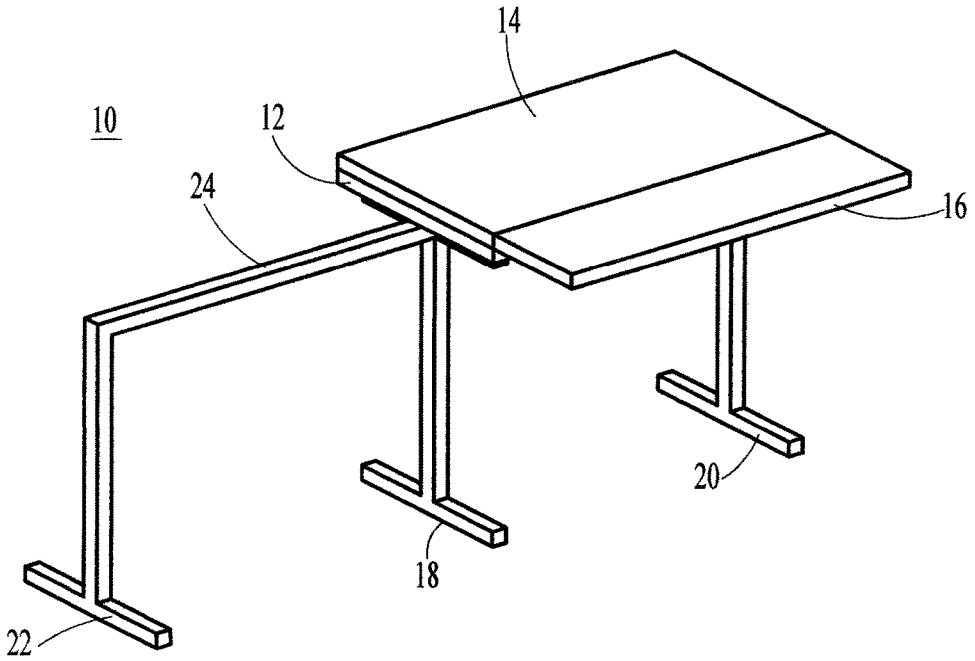
Figure 6:
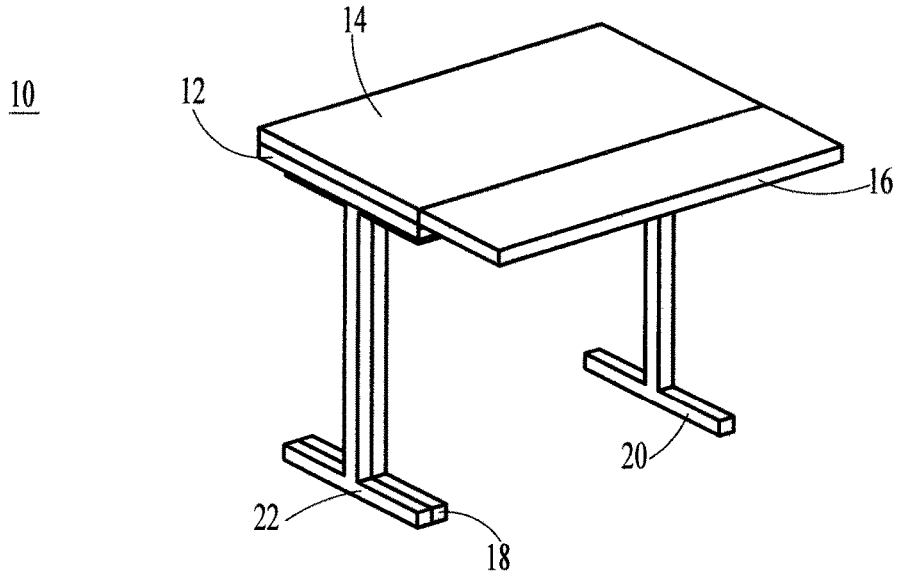
FIG. 6 illustrates the collaborative configuration of the preferred embodiment of the present disclosure.

For example, the table 10 may be 8' long and 2' wide. The table 10 folds to 4' long by 3' wide, for example, as shown in FIG. 6 to allow for collaboration. The book style fold, as shown in FIG. 2, allows for full use of the table in both forms. The sliding third leg 22 is key to making this design work well. When the table is in the small collaboration style configuration shown in FIG. 6, the leg 22 easily stows next to the other leg 18. The speed with which this table can be transformed is also key. The ease of use allows the table to be changed quickly by one person.

Figure 7:
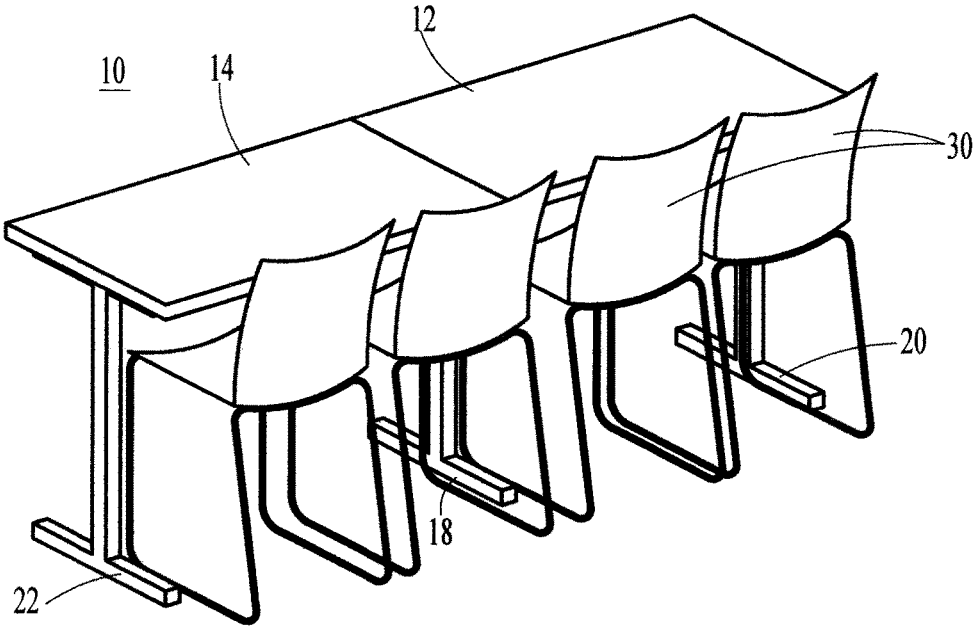
FIG. 7 illustrates the lecture style configuration of the preferred embodiment of the present disclosure with chairs.
Figure 8:
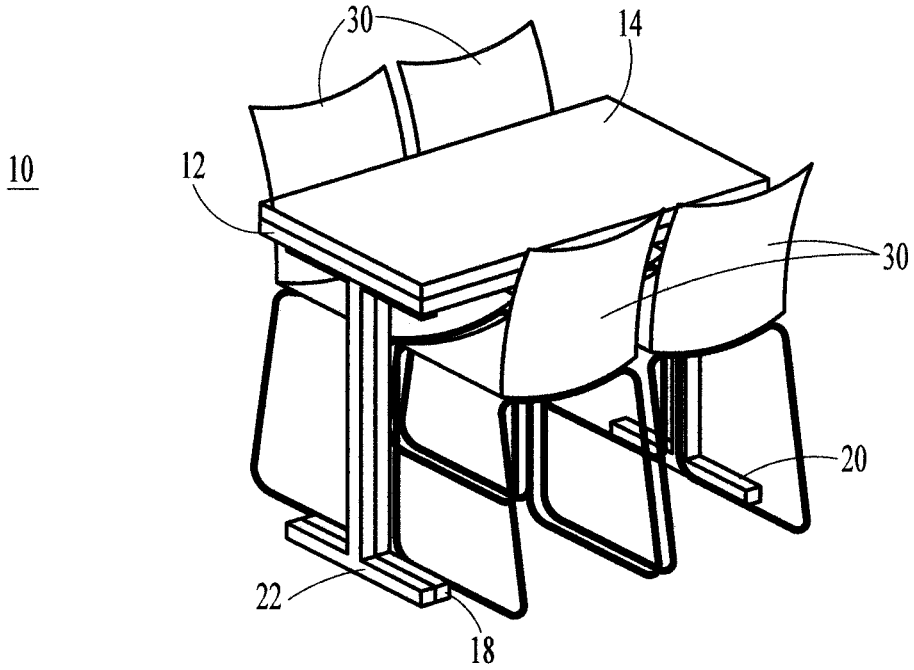
FIG. 8 illustrates the collaborative configuration of the preferred embodiment of the present disclosure with chairs.
Figure 11:
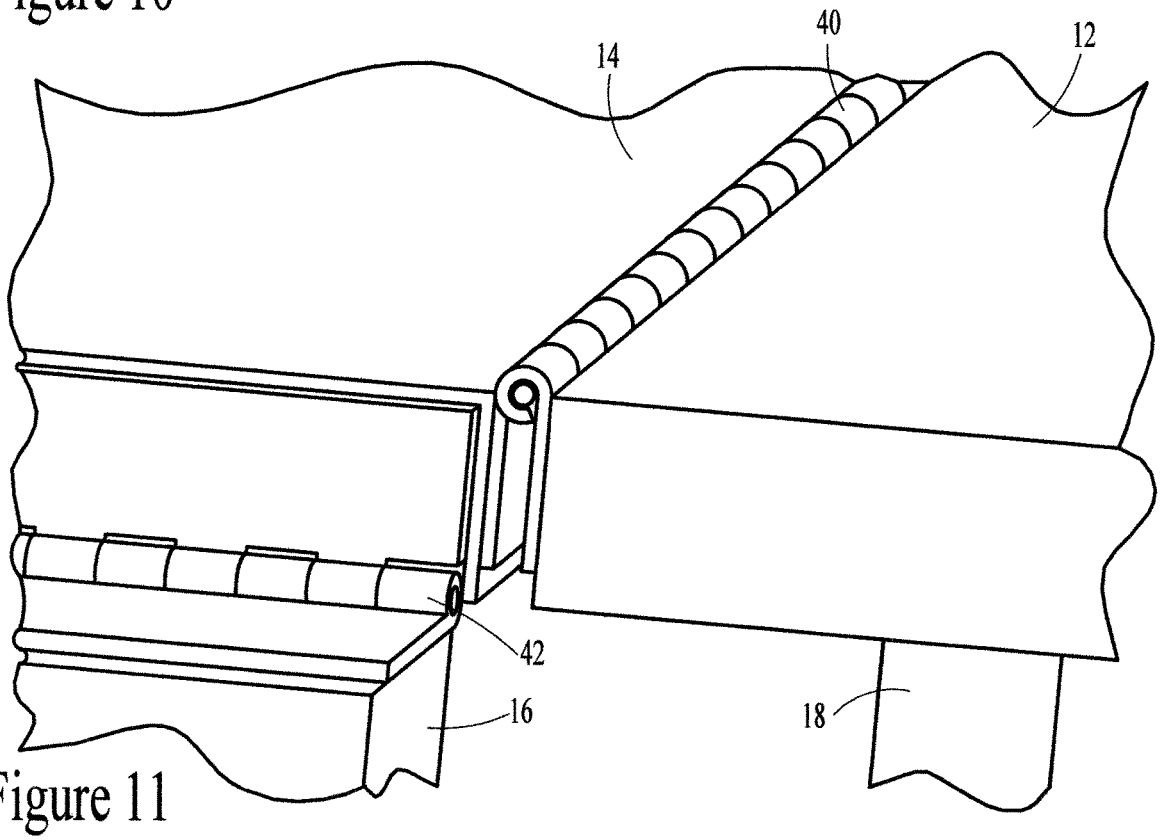
FIG. 11 illustrates an enlarged view of hinge mechanisms in a preferred embodiment of the present disclosure.

The expandable table of the disclosure, in a preferred embodiment, allows for a table to transform between a long lecture style table with four seats 30 on one side, as illustrated in FIG. 7, and then folded into a shorter table, as illustrated in FIG. 8, for collaboration with two seats 30 on each of two opposing sides, four seats in total. It will be understood that other sizes are anticipated, such as a long table for six students that is folded into a table for three students on each side, for example. FIGS. 2 through 5 illustrate the conversion of the lecture style table to the collaboration style table. The Table 10 consists of two separate tabletop sections 12 and 14 that are approximately 4 feet long, for example, and vary in depth from 18" to 30" wide, depending on customer preference. Each section is connected with a hinge 40, as illustrated in FIG. 11, on the short side that allows one piece to fold on top of the other, making the table half as long. Hinge 40 is an example of one possible type of hinge. Other hinge types may be used, especially a hinge that would be flush with the top of the table.

Figure 5:
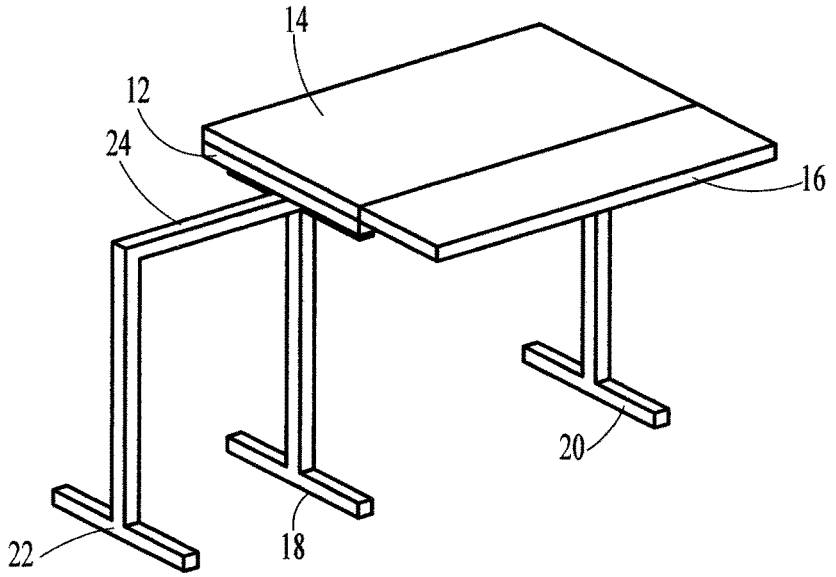

Also attached to one side 14 of the long length is an optional 8"-12" wide piece 16 that will flip down on hinge 42 to make the table size 8-12" wider. This extra piece can only be flipped up in the shorter collaborative configuration, as shown in FIGS. 5 and 6. The additional fold down piece 16 to widen the table for use in the collaboration configuration can also be used as a modesty panel in school applications, as shown in FIGS. 1A and 1B, but only on one half of the table.

Figure 12A:
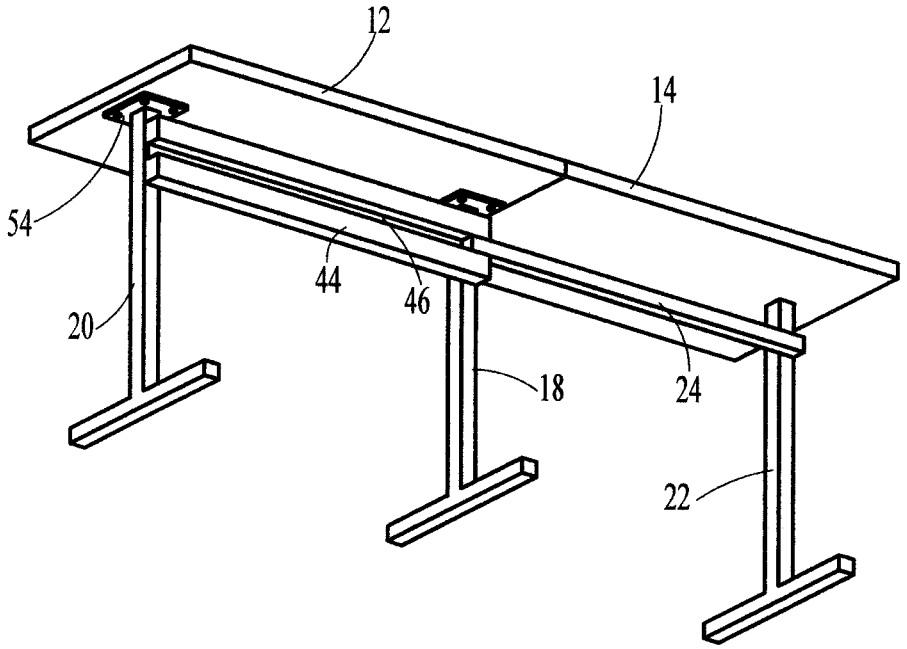
FIGS. 12A and 12B illustrate a sliding mechanism of a preferred embodiment of the present disclosure and two alternative leg styles.
Figure 12B:
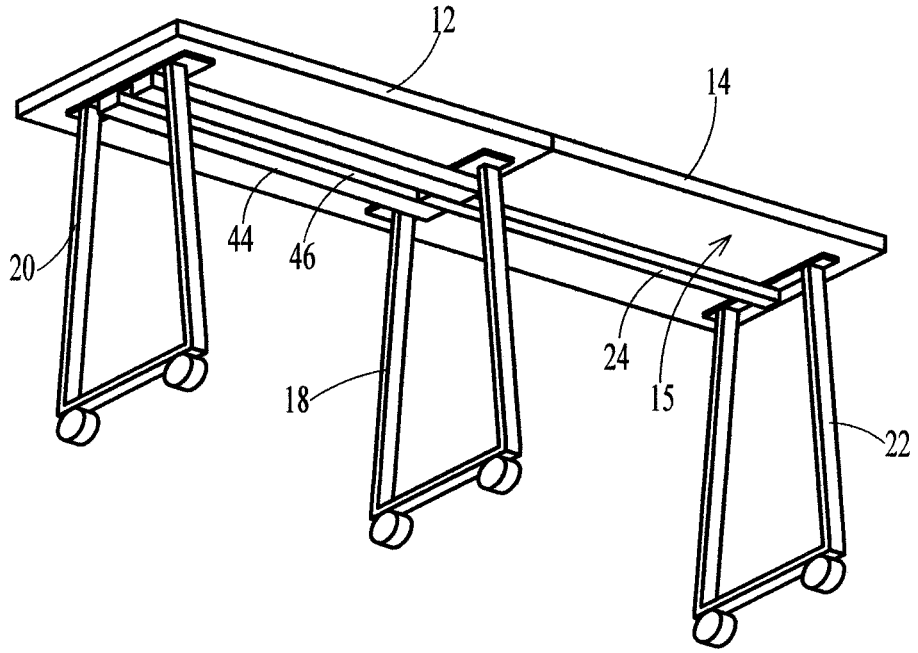

The table 10 has three legs 18, 20, 22 that allow for this unique configuration. Two of the legs, 18 and 20, are fixed to the stationary side 12 of the table. As shown in FIGS. 12A and 12B (in examples of two possible leg styles shown in FIGS. 1A and 1B, respectively), there is a full extension slide 44 on the underside of the stationary side of the table. The third leg 22 is attached to this slide 44. This feature allows for the third leg to slide out or in depending on the desired configuration of the table. FIG. 12A illustrates an example of the slide 44 attached vertically to leg attachment plates 54 where a channel 46 for slidable bar 24 is vertically oriented. FIG. 12B illustrates an example of slide 44 attached to the underside of the table 12 where a channel 46 for receiving slidable bar 24 is horizontally oriented. Other slidable mechanisms can be used.

Figure 9:
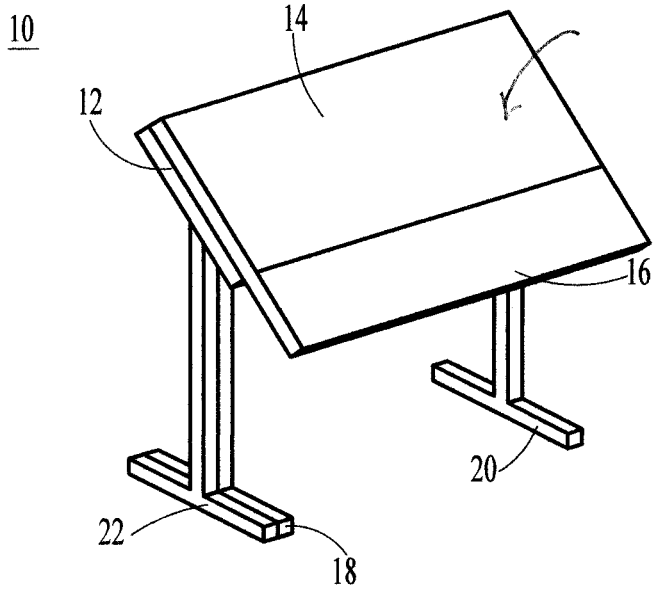
FIGS. 9 and 10 illustrate a white board configuration of the preferred embodiment of the present disclosure.
Figure 10:
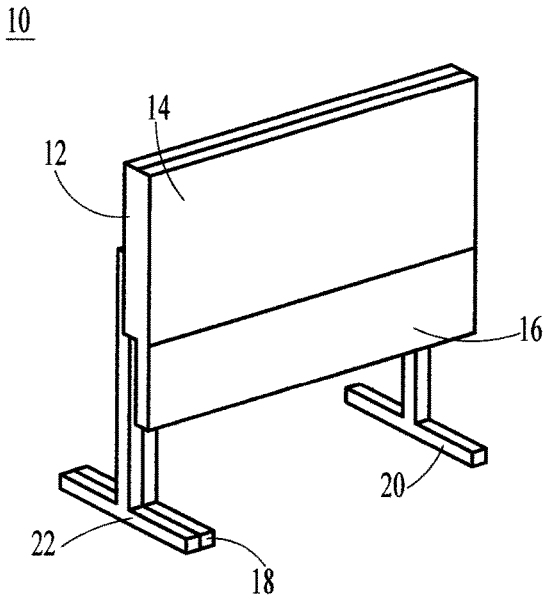
Figure 13:
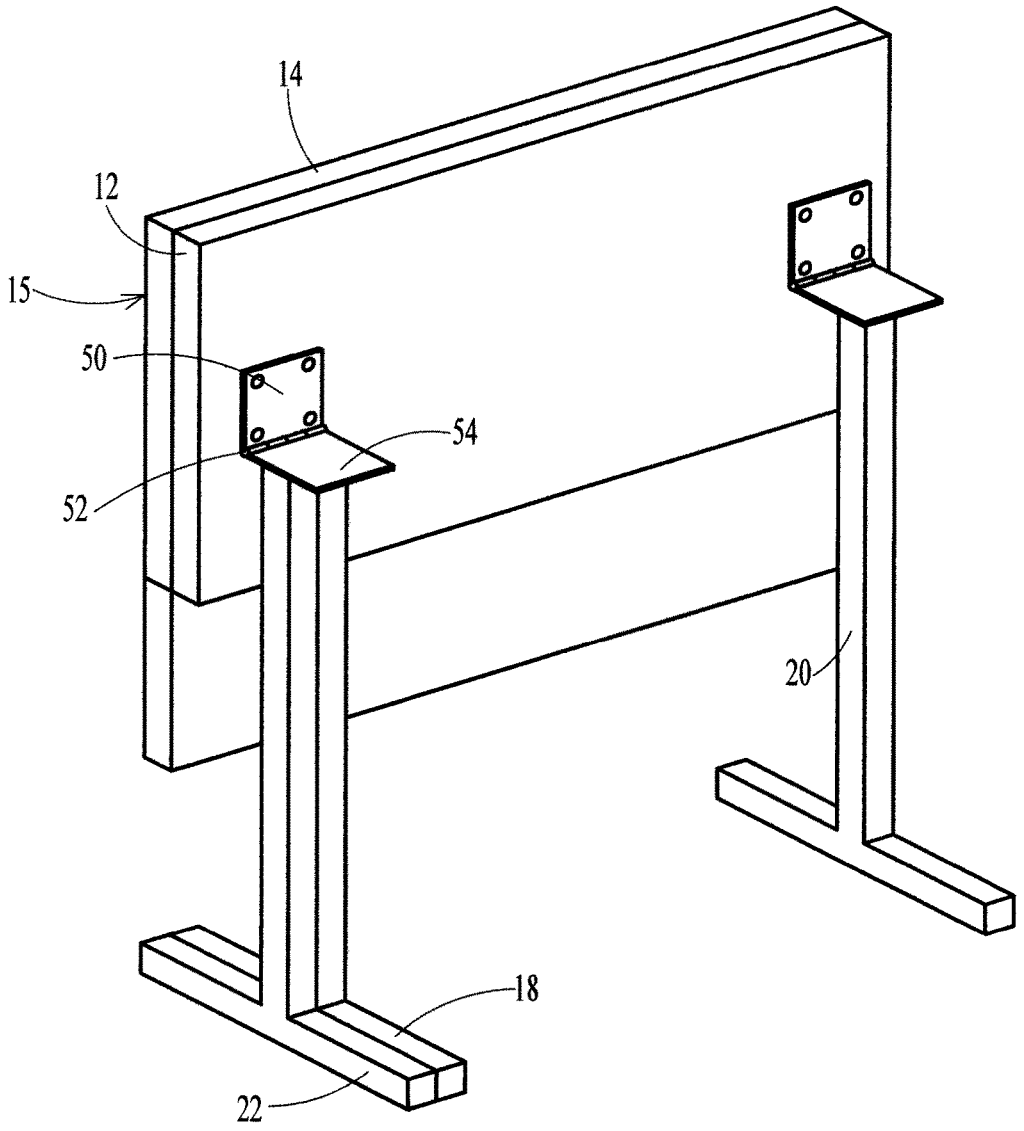
FIG. 13 illustrates a stacking configuration from the underside of a preferred embodiment of the present disclosure.

Additionally, as shown in FIGS. 9 and 10, the table can be rotated 90 degrees on the vertical axis for nesting storage and to function as a mobile whiteboard. Several tables can be stored with tabletops and legs touching each other in a compact space. FIG. 13 illustrates legs 18 and 20 attached to plates 54. Plates 54 are hinged 52 to plates 50 attached to the underside of the table 12. The hinges 52 allow the table top to be rotated 90 degrees for nesting storage or to function as a mobile whiteboard. The whiteboard surface would be on the underside 15 of table surface 14. A whiteboard surface might also be advantageous in the collaboration configuration where the underside 15 of the table surface 14 is facing up.

The present disclosure has described an expandable table having the following features:

1) book style folding motion with hinge attached to the short side of the table 2) sliding leg that allows a third leg to easily slide in and out 3) table configuration can be changed by one person 4) table configuration can be changed in seconds 5) additional optional fold down surface to widen the table for use; this feature also can be used as a modesty panel in school applications 6) table top rotates 90 degrees on the vertical axis to create a nesting feature. In this scenario, a write board surface is exposed and the table can be used as a mobile white board.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. An expandable table comprising:

first and second table surfaces connected by a first hinge at their adjoining short sides;

first and second legs fixed to an underside of said first table surface to support said first table surface; and a third leg fixed to a slidable mechanism wherein said slidable mechanism is installed on an underside of said first table surface, wherein said slidable mechanism is configured to be slid out from under said first table surface when said second table surface is unfolded wherein said second table surface is supported by said third leg and wherein said third leg rests adjacent to said first leg when said second table surface is folded to lie on top of said first table surface.

2. The table according to claim 1 further comprising a third table surface connected by a second hinge along a long side of said second table surface.

3. The table according to claim 2 wherein said third table surface is configured to hang vertically downward from said second table surface to serve as a modesty panel.

4. The table according to claim 2 wherein said third table surface is configured to extend horizontally outward from said second table surface to increase the width of said second table surface.

5. The table according to claim 2 wherein an underside of said second table surface and said third table surface comprise a white board material.

6. The table according to claim 1 wherein said table is in a lecture style configuration when said second table surface is unfolded from said first table surface and supported by said third leg.

7. The table according to claim 1 wherein said table is in a collaboration style configuration when said second table surface is folded onto said first table surface and said third leg is resting adjacent to said first leg.

8. The table according to claim 7 wherein said first table surface is configured to be pivoted on a vertical axis wherein said first and second table surfaces maintain a vertical orientation.

9. The table according to claim 8 wherein said vertical orientation facilitates nesting storage of multiple tables.

10. The table according to claim 8 wherein an exposed surface of said second table surface comprises a white board material and wherein said vertical orientation allows said table to function as a mobile whiteboard.

11. A method to convert a table from a lecture style configuration to a collaboration style configuration comprising:

providing an expandable table comprising:

first and second table surfaces connected by a first hinge at their adjoining short sides;

first and second legs fixed to an underside of said first table surface to support said first table surface; and a third leg fixed to an end of a slidable mechanism wherein said slidable mechanism is installed on an underside of said first table surface;

wherein in said lecture style configuration, said first and second table surfaces together form a fourth table surface equal to the combined length of said first and second table surfaces, wherein said first table surface is supported by said first and second legs and wherein said second table surface is supported by said third leg;

folding said second table surface onto said first table surface so that an underside of said second table surface is exposed; and sliding said slidable mechanism in to its fullest extent wherein said third leg rests adjacent to said first leg to form said collaboration style configuration.

12. The method according to claim 11 further comprising a third table surface connected by a second hinge along a long side of said second table surface wherein in said lecture style configuration, said third table surface hangs vertically downward from said second table surface, and further comprising unfolding said third table surface to form a fifth table surface equal to the combined widths of said second and third table surfaces to increase a useable width of said table.

13. The method according to claim 11 further comprising pivoting said first table surface on a vertical axis wherein said first and second table surfaces assume a vertical orientation.

14. The method according to claim 13 wherein said vertical orientation facilitates nesting storage of multiple tables.

15. The method according to claim 13 wherein exposed surfaces of said second table surface and said third table surface comprise a white board material and wherein said vertical orientation allows said table to function as a mobile whiteboard.

16. A method to convert a table from a collaboration style configuration to a lecture style configuration comprising:

providing an expandable table comprising:

first and second table surfaces connected by a first hinge at their adjoining short sides;

first and second legs fixed to an underside of said first table surface to support said first table surface; and a third leg fixed to an end of a slidable mechanism wherein said slidable mechanism is installed on an underside of said first table surface;

wherein in said collaboration style configuration, said second table surface is folded over said first table surface;

sliding said slidable mechanism out to its fullest extent; and thereafter unfolding said second table surface from said first table surface and resting said second table surface on said third leg to form a fourth table surface equal to the combined length of said first and second table surfaces, wherein said first table surface is supported by said first and second legs and wherein said second table surface is supported by said third leg to form said lecture style configuration.

17. The method according to claim 16 further comprising a third table surface connected by a second hinge along a long side of said second table surface wherein in said collaboration style configuration, said third table surface is unfolded to form a fifth table surface equal to the combined widths of said second and third table surfaces to increase a usable width of said table, and further comprising folding said third table surface downward to form a right angle between said second table surface and said third table surface to serve as a modesty panel.

18. The method according to claim 16 wherein said fourth table surface comprises a white board material.

19. The method according to claim 16 further comprising pivoting said first table surface on a vertical axis wherein said first and second table surfaces assume a vertical orientation.

20. The method according to claim 16 wherein said fourth table surface comprises a white board material, and wherein said vertical orientation allows said table to function as a mobile whiteboard.

* * * * *